US009140474B2

(12) United States Patent
Jang et al.

(10) Patent No.: US 9,140,474 B2
(45) Date of Patent: Sep. 22, 2015

(54) AIR CONDITIONER

(75) Inventors: Jiyoung Jang, Changwon-si (KR); Baikyoung Chung, Changwon-si (KR); Youngcheol Sa, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 736 days.

(21) Appl. No.: 13/241,464

(22) Filed: Sep. 23, 2011

(65) Prior Publication Data

US 2012/0118533 A1 May 17, 2012

(30) Foreign Application Priority Data

Nov. 18, 2010 (KR) ..... 10-2010-0115001

(51) Int. Cl.

| | |
|---|---|
| ***F25B 13/00*** | (2006.01) |
| ***F25B 49/02*** | (2006.01) |
| ***F28F 9/02*** | (2006.01) |
| ***F28F 27/02*** | (2006.01) |
| ***F25B 41/00*** | (2006.01) |

(52) U.S. Cl.

CPC ..... *F25B 49/02* (2013.01); *F25B 41/003* (2013.01); *F28F 9/0275* (2013.01); *F28F 27/02* (2013.01); *F25B 13/00* (2013.01); *F25B 2313/02334* (2013.01); *F25B 2313/02344* (2013.01)

(58) Field of Classification Search

CPC ..... F25B 13/00; F25B 30/02; F25B 41/046; F25B 41/06; F25B 39/02; F25B 41/062; F28F 27/00

USPC ..... 62/115, 160, 222, 324.6, 498, 513, 511, 62/524, 526, 527; 165/96

See application file for complete search history.

(56) References Cited

U.S. PATENT DOCUMENTS

| | | | | |
|---|---|---|---|---|
| 4,389,851 | A * | 6/1983 | Chrostowski et al. | 62/81 |
| 5,590,532 | A * | 1/1997 | Bachman | 62/3.3 |
| 5,651,265 | A * | 7/1997 | Grenier | 62/260 |
| 7,055,590 | B2 * | 6/2006 | Hara | 165/202 |

FOREIGN PATENT DOCUMENTS

| | | | |
|---|---|---|---|
| JP | 8-261691 | A | 10/1996 |
| JP | 10-170081 | A | 6/1998 |
| JP | 10-220893 | A | 8/1998 |
| JP | 11-037587 | A | 2/1999 |
| JP | 2000-146258 | A | 5/2000 |
| JP | 2000-320927 | A | 11/2000 |
| JP | 2002-318031 | A | 10/2002 |
| JP | 2003-121019 | | 4/2003 |

* cited by examiner

*Primary Examiner* — Melvin Jones

(74) *Attorney, Agent, or Firm* — Dentons US LLP

(57) ABSTRACT

An air conditioner includes an outdoor heat exchanger that is divided into a plurality of unit paths. at least two of the plurality of unit paths are connected in series or parallel to one another according to cooling/heating operation, so that it is possible to vary the number or length of paths through which a refrigerant passes. Since the number or length of paths is properly selected and used, it is possible to enhance efficiency.

20 Claims, 14 Drawing Sheets

AIR CONDITIONER

This application claims the priority to Korean Application No. 10-2010-0115001, filed on Nov. 18, 2010, which are hereby incorporated by reference in their entirety.

BACKGROUND

1. Field of the Disclosure

The present disclosure relates to an air conditioner, and more particularly to an air conditioner in which the refrigerant path of a heat exchanger in cooling operation is different from the refrigerant path of the heat exchanger in heating operation, so that the optimal heat exchange efficiency may be maintained during the cooling/heating operation.

2. Background

In general, an air conditioner comprises a heating apparatus, a cooling apparatus, a heat pump, an air cleaner, and etc.

The air conditioner is an apparatus that cools or heats an indoor space by performing processes of compressing, condensing, expanding and evaporating a refrigerant. An conditioner is classified into a general air conditioner in which a single indoor unit is connected to an outdoor unit or a multi-air conditioner in which a plurality of indoor units are connected to an outdoor unit. The air conditioner includes a compressor, a condenser, an expanding valve and an evaporator. A refrigerant discharged from the compressor is condensed in the condenser and then expanded in the expanding valve. The expanded refrigerant is evaporated in the evaporator and then sucked into the compressor.

In the case of an air conditioner capable of performing cooling and heating operations, when the air conditioner is in the cooling operation, an outdoor heat exchanger serves as a condenser that condenses a high-temperature and high-pressure refrigerant discharged from a compressor into a liquefied refrigerant by performing heat exchange. An indoor heat exchanger serves as an evaporator. When the air conditioner is in the heating operation, the outdoor heat exchanger serves as an evaporator that evaporates a refrigerant in a mixture state of gas and liquid collected from the indoor heat exchanger into a refrigerant that is in a gaseous state by performing a heat exchange. The indoor heat exchanger serves as a condenser.

In the conventional air conditioner, states of the refrigerant that passes through the outer heat exchanger are different in the cooling and heating operation, and flow rates of the refrigerant are different according to whether the state of the refrigerant is in liquefied or gaseous state. Further, performances of heat exchange are different from each other according to the flow rate of the refrigerant.

SUMMARY

Therefore, the number or length of refrigerant paths in the outdoor heat exchanger should be controlled so as to have the optimal flow rate of the refrigerant.

However, since the number or length of refrigerant paths is identically fixed in the cooling and heating operations, the conventional air conditioner is designed to provide optimal performance in one of the cooling and heating operations. Therefore, it is unavoidable that the performance of the other of the cooling and heating operations is deteriorated.

An aspect of the present invention is to provide an air conditioner capable of maintaining a heat exchanger to have the optimal heat exchange efficiency during cooling/heating operation.

In accordance with an aspect of the present invention, there is provided an air conditioner including a heat exchanger including a refrigerant path divided into a plurality of unit paths, and a path switch part that connects at least two of the plurality of unit paths in parallel to one another in heating operation or switches at least two of the plurality of unit paths to be connected in series to one another in cooling operation.

In accordance with another aspect of the present invention, there is provided an air conditioner including a heat exchanger including a refrigerant path divided into a plurality of unit paths, a parallel connection path that connects at least two of the plurality of unit paths in parallel to one another, a series connection path that connects at least two of the plurality of unit paths in series to one another, and a path switch part that is provided to at least one of the parallel and series connection paths to switch paths so that the parallel and series connection paths are selectively used according to cooling/heating operation.

In accordance with still another aspect of the present invention, there is provided an air conditioner including a heat exchanger including a plurality of unit paths, a first parallel connection path that connects entrance sides of at least two of the plurality of unit paths in parallel to one another so that a refrigerant flows into the at least two of the plurality of unit paths connected in parallel in heating operation, a second parallel connection path that connects exit sides of the at least two of the plurality of unit paths in parallel to one another so that the refrigerant passing through the at least two of the plurality of unit paths connected in parallel is gathered in the heating operation, a series connection path that connects at least two of the plurality of unit paths in series to one another so that the refrigerant passing through one of the at least two of the plurality of unit paths is passed to an entrance side of another unit path in series in the cooling operation; a series connection valve provided to the series connection path to open the series connection path in cooling operation with a predetermined reference load range and to close the series connection path in low-temperature cooling operation that exceeds the reference load range, a first parallel connection valve provided to the first parallel connection path to open the first parallel connection path in the heating operation and the low-temperature cooling operation, and a second parallel connection valve provided to the second parallel connection path to close the second parallel connection path in the cooling operation with the reference load range and the low-temperature cooling operation.

In air conditioners according to various embodiments of the present invention as configured above, it may be possible to increase/decrease the number or length of paths through which a refrigerant passes. Thus, since the number or length of paths is properly selected and used to obtain the optimal efficiency according to the state of the refrigerant, the efficiency may be enhanced.

Also, in low-temperature cooling operation, the refrigerant passes through at least a portion of the plurality of unit paths, so that the unit paths may be properly used according to a load.

DETAILED DESCRIPTION OF THE PREFERRED EMBODIMENT

Figure 1:
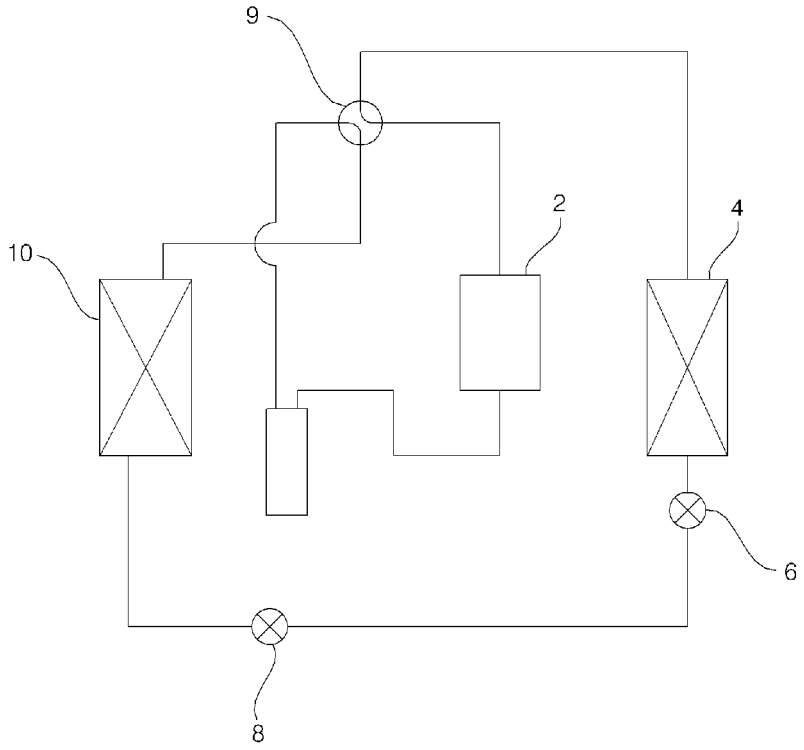
FIG. 1 is a schematic diagram illustrating a configuration of an air conditioner according to a first embodiment of the present invention.

Hereinafter, exemplary embodiments of the present invention will be described in detail with reference to the accompanying drawings. However, the present invention is not limited to the embodiments but may be implemented into different forms. These embodiments are provided only for illustrative purposes and for understanding of the present invention by those skilled in the art. Throughout the drawings, like elements are designated by like reference numerals.

FIG. 1 is a schematic diagram illustrating a configuration of an air conditioner according to a first embodiment of the present invention.

Referring to FIG. 1, the air conditioner according to the first embodiment of the present invention includes a compressor 2 that compresses a refrigerant, an indoor heat exchanger 4 provided in an interior of a room to serve as an evaporator in cooling operation and to serve as a condenser in heating operation, an outdoor heat exchanger 10 provided at an outside of the room to serve as the condenser in the cooling operation and to serve as the evaporator in the heating operation, expanders 6 and 8 that expand the refrigerant passing through the condenser, and a four-way valve 9 that switches a path so that the refrigerant discharged from the compressor flows into the indoor heat exchanger 4 or the outdoor heat exchanger 10.

The air conditioner includes a heat pump for heating and cooling the indoor space.

Figure 2:
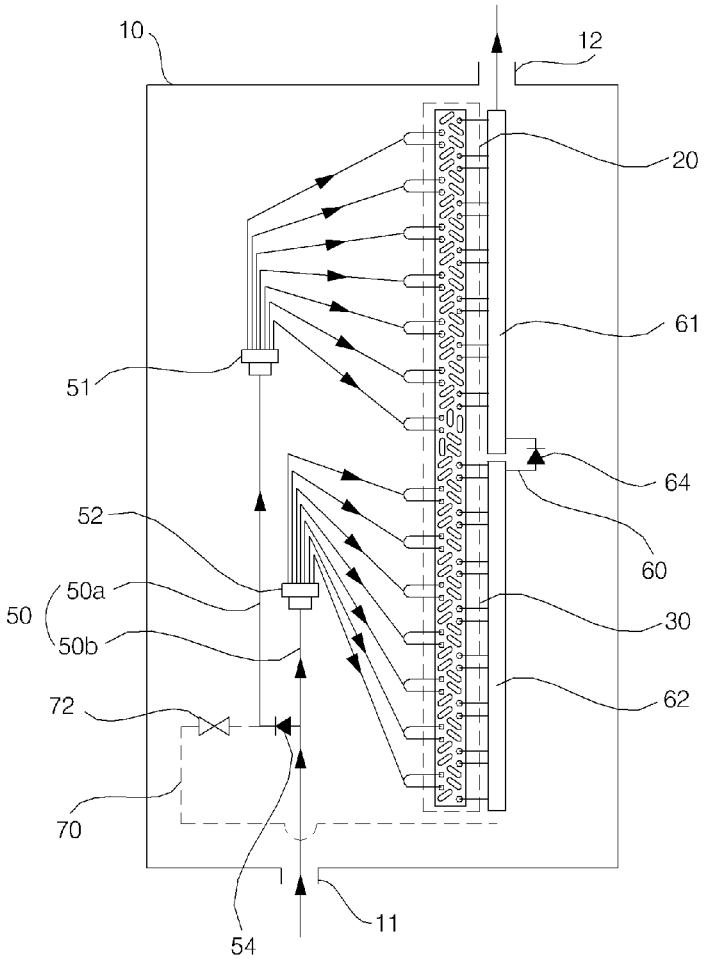
FIG. 2 is a schematic diagram illustrating the flow of a refrigerant in an outdoor heat exchanger shown in FIG. 1 when the air conditioner is in heating operation according to the first embodiment of the present invention.
Figure 3:
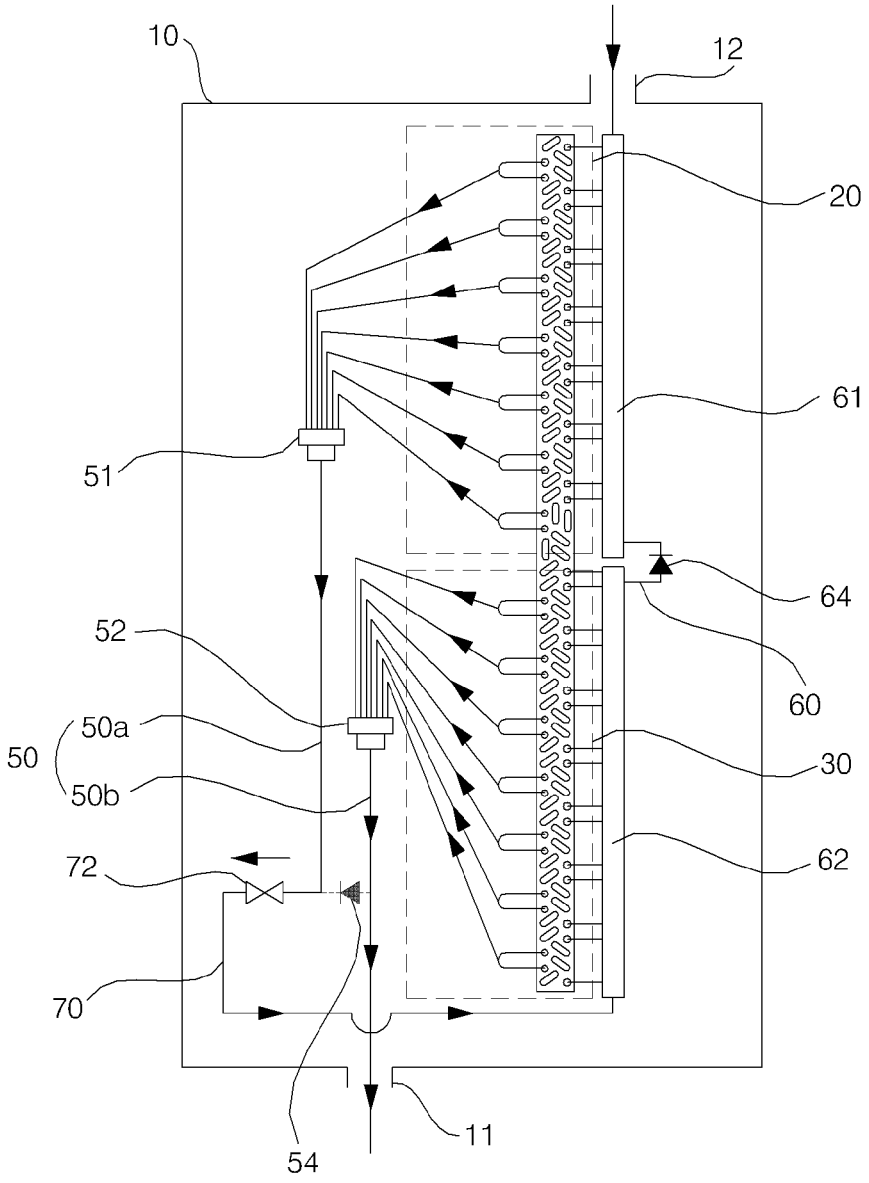
FIG. 3 is a schematic diagram illustrating the flow of the refrigerant in the outdoor heat exchanger when the air conditioner is in cooling operation according to the first embodiment of the present invention.

FIG. 2 is a schematic diagram illustrating the flow of a refrigerant in an outdoor heat exchanger shown in FIG. 1 when the air conditioner is in heating operation according to the first embodiment of the present invention. FIG. 3 is a schematic diagram illustrating the flow of the refrigerant in the outdoor heat exchanger when the air conditioner is in cooling operation according to the first embodiment of the present invention.

Referring to FIGS. 2 and 3, the outdoor heat exchanger 10 according to the first embodiment of the present invention has a refrigerant path divided into a plurality of unit paths. Although it has been described in this embodiment that the refrigerant path of the outdoor heat exchanger 10 is divided into two unit paths, it is not limited thereto but may be divided into two or more unit paths. In this embodiment, the refrigerant path of the outdoor heat exchanger 10 is divided into a first unit path 20 and a second unit path 30.

One side of the first unit path 20 and one side of the second unit path 30 are connected in parallel to each other by a first parallel connection path 50, and the other side of the first unit path 20 and the other side of the second unit path 30 are connected in parallel to each other by a second parallel connection path 60.

A first distributor 51 and a second distributor 52 respectively corresponding to the first unit path 20 and the second unit path 30 are provided on the first parallel connection path 50.

The first distributor 51 distributes a refrigerant flowing into the outdoor heat exchanger 10 in heating operation to the interior of the first unit path 20, and the second distributor 52 distributes the refrigerant flowing into the outdoor heat exchanger 10 in the heating operation to the interior of the second unit path 30.

The first parallel connection path 50 includes a first distributor connection path **50*a* that connects a gateway of the outdoor heat exchanger 10 and the first distributor 51, and a second distributor connection path 50*b* that connects the gateway of the outdoor heat exchanger 10 and the second distributor 52**.

A first header 61 and a second header 62 are provided at portions corresponding to the first unit path 20 and the second unit path 30 on the second parallel connection path 60, respectively.

The positions at which the distributor and the header are provided may be changed. However, since it is advantageous that the distributor is provided at a side into which a liquefied refrigerant flows and the header is provided at a side into which a gaseous refrigerant flows, the distributor may be disposed at a side of a first gateway 11 through which a two-phase refrigerant flows in heating operation and the header may be disposed at a side of a second gateway 12 through which a gaseous refrigerant flows in cooling operation.

The outdoor heat exchanger 10 further includes a path switch part that switches a path so that the first parallel connection path 50, the second parallel connection path 60 and a series connection path which will be described later are selectively used according to the cooling/heating operation.

The switching of the path switch part may be performed by a controller. The controller may be a microprocessor, a custom chip, a logic circuitry, and the like.

The path switch part may include an opening/closing valve provided to at least one of the first parallel connection path 50, the second parallel connection path 60 and the series connection path 70 to open/close the paths. The path switch part may include a check valve that allows a refrigerant to flow only in one direction.

The path selector includes a parallel connection valve 64, a series connection valve 72 and a backflow prevention valve 54, which will be described later.

The parallel connection valve 64 is provided to the second parallel connection path 60. The parallel connection valve 64 closes the second parallel connection path 60 in the cooling operation and opens the second parallel connection path 60 in the heating operation. The opening/closing of the parallel connection valve 64 may be performed by the controller.

In the heating operation, the parallel connection valve 64 communicates the first and second header 61 and 62 with each other so that the second parallel connection path 60 is opened. In the cooling operation, the parallel connection valve 64 closes the second parallel connection path 60 so that the refrigerant passing through the first header 61 does not flow into a side of the second header 62. In this embodiment, a check valve is used as the parallel connection valve 64. The check valve allows the refrigerant to flow only in a direction toward the first header 61 from the second header 62.

The first and second headers 61 and 62 may be provided on the first parallel connection path 50, and the first and second distributors 51 and 52 may be provided on the second parallel connection path 60. However, the distributor is preferably provided to the side through which the liquefied refrigerant passes rather than the header.

The outdoor heat exchanger 10 further includes a series connection path 70 that connects the first and second unit paths 20 and 30 in parallel to each other.

The series connection path 70 is formed so that the refrigerant passing through the first unit path 20 is bypassed to an entrance side of the second unit path 30 in the cooling operation. That is, the series connection path 70 is bypassed from the first distributor path 50*a* to be connected to the second header 62.

The series connection valve 72 is provided to the series connection path 70. The series connection valve 72 opens the series connection path 70 in the cooling operation and closes the series connection path 70 in the heating operation. The opening/closing of the series connection valve 72 may be perfomed by the controller.

The backflow prevention valve 54 is provided to the first parallel connection path 50. The backflow prevention valve 54 prevents the refrigerant passing through the first unit path 20 from flowing back to an exit side of the second unit path 30 in the cooling operation. That is, the backflow prevention valve 54 is provided between the first and second distributor paths 50*a* and 50*b*, and a check valve may be used as the backflow prevention valve 54.

Figure 4:
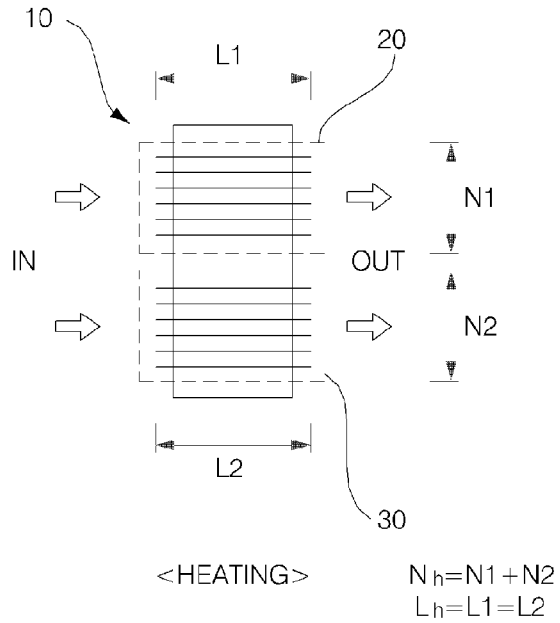
FIG. 4 is a schematic diagram illustrating a unit path of the outdoor heat exchanger and the length of a path when the air conditioner is in heating operation according to the first embodiment of the present invention.
Figure 5:
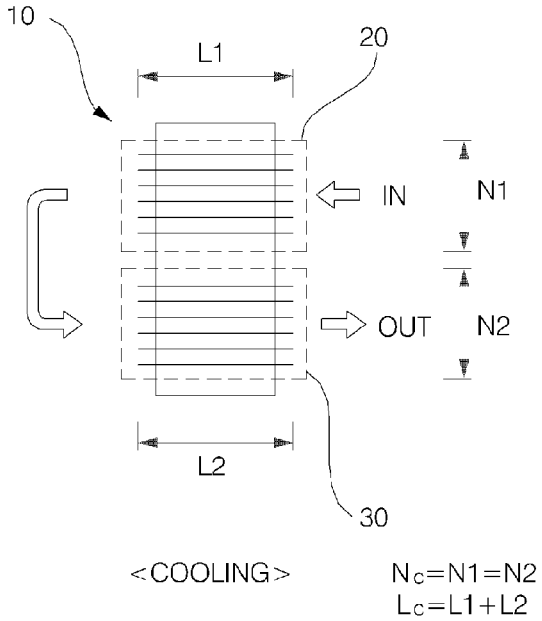
FIG. 5 is a schematic diagram illustrating a unit path of the outdoor heat exchanger and the length of a path when the air conditioner is in cooling operation according to the first embodiment of the present invention.

FIG. 4 is a schematic diagram illustrating a unit path of the outdoor heat exchanger and a length of a path when air conditioner is in heating operation according to the first embodiment of the present invention. FIG. 5 is a schematic diagram illustrating a unit path of the outdoor heat exchanger and a length of a path when air conditioner is in cooling operation according to the first embodiment of the present invention.

Referring to FIG. 4, when the air conditioner is in the heating operation, the first and second unit paths 20 and 30 are connected in parallel to each other, and hence the number $N_h$ of paths through which the refrigerant passes equals to the sum of the number N1 of paths in the first unit path 20 and the number N2 of paths in the second unit path 30. The length $L_h$ of paths through which the refrigerant passes equals to the length L1 of the first unit path 20. Since the number of paths through which the refrigerant passes equals to the number of entrances through which the refrigerant flows or the number of exits through which the refrigerant discharge, the number of paths may be described as the number of entrances or the number of exits. However, for convenience of illustration, the number $N_h$ of paths will be described below.

Referring to FIG. 5, when the air conditioner is in the cooling operation, the first and second unit paths 20 and 30 are connected in series to each other, and hence the number $N_c$ of paths through which the refrigerant passes equals to the number N1 of paths in the first unit path 20 (N1=N2). The length $L_c$ of paths through which the refrigerant passes equals to the sum of the length L1 of the first unit path 20 and the length L2 of the second unit path 30.

In this embodiment, the total refrigerant path of the outdoor heat exchanger 10 is divided into the first and second unit paths 20 and 30. That is, the length L1 of the first unit path 20 and the length L2 of the second unit path 30 equal to each other.

In the cooling operation, the first and second unit paths 20 and 30 are connected in series to each other, so that the number $N_c$ of paths through which refrigerant passes in the cooling operation is smaller than that in the heating operation and the length $L_c$ of paths through which the refrigerant passes in the cooling operation is longer than that in the heating operation. Thus, it is possible to increase the flow speed of the refrigerant passing through the outdoor heat exchanger 10 that serves as a condenser.

In the heating operation, the first and second unit paths 20 and 30 are connected in parallel to each other, so that the number $N_h$ of paths through which refrigerant passes in the heating operation is greater than that in the cooling operation and the length $L_h$ of paths through which the refrigerant passes in the heating operation is shorter than that in the cooling operation. Thus, it is possible to decrease the flow speed of the refrigerant passing through the outdoor heat exchanger 10 that serves as an evaporator.

Figure 6:
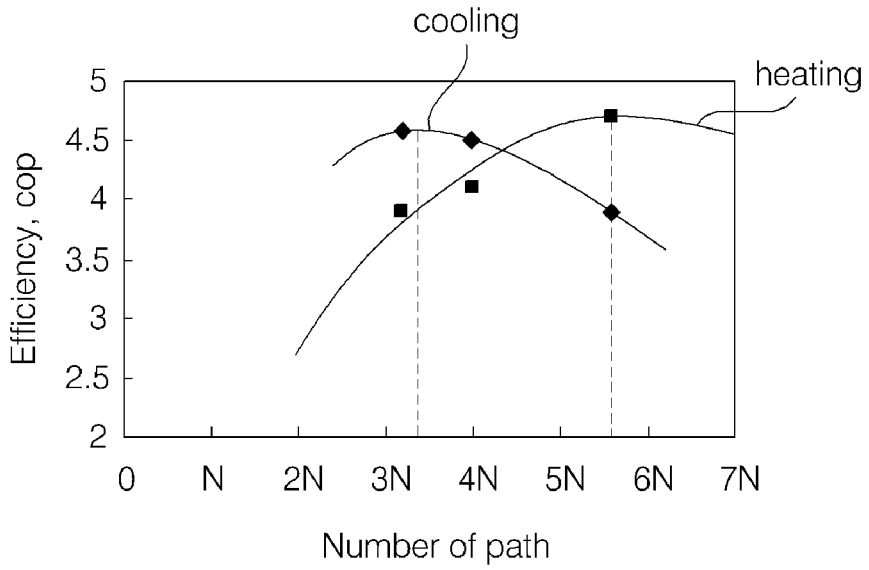
FIG. 6 is a graph illustrating a relationship between the number of paths and performance of the outdoor heat exchanger.

FIG. 6 is a graph illustrating a relationship between the number of paths through which the refrigerant passes and the performance in the outdoor heat exchanger.

Referring to FIG. 6, as the number $N_h$ of paths through which refrigerant passes in the heating operation is increased, the performance of the outdoor heat exchanger is enhanced. The increase of the number of paths through which refrigerant passes in the heating operation means that the length of paths through which the refrigerant passes in the heating operation is shortened.

When the number $N_c$ of paths through which refrigerant passes in the cooling operation is smaller than the number $N_h$ of paths in the heating operation, the optimal performance of the outdoor heat exchanger may be achieved. That is, when the length of paths in the cooling operation is longer than the length of paths in the heating operation, the optimal performance of the outdoor heat exchanger may be achieved.

Since the number of paths for the optimal performance in the heating operation and the number of paths for the optimal performance in the cooling operation are different from each other, the number and length of paths are properly varied according to the cooling/heating operation, thereby ensuring optimal performance.

The operation of the outdoor heat exchanger according to the first embodiment of the present invention will now described as follows.

Referring to FIG. 2, when the air conditioner according to the first embodiment of the present invention is in the heating operation, the outdoor heat exchanger 10 is used as an evaporator.

A two-phase refrigerant in a low-temperature and low-pressure state, in which gas and liquid are mixed together, flows through the first gateway 11 the outdoor heat exchanger 10 through the first gateway 11 and then flows into the first and second distributors 51 and 52 through the first parallel connection path 50.

Since the series connection valve 72 closes the series connection path 70, the refrigerant may flow into only the side of the first parallel connection path 50. That is, the first and second unit paths 20 and 30 are connected in parallel to each other by the first parallel connection path 50.

The first distributor 51 distributes the refrigerant to the first unit path 20 and the second distributor 52 distributes the refrigerant to the second unit path 30.

The refrigerant evaporated while passing through the first unit path 20 is gathered in the first header 61 and then discharged to the exterior through the second gateway 12 of the outdoor heat exchanger 10.

The refrigerant evaporated while passing through the second unit path 30 is gathered in the second header 62, moved to the side of the first header 61 through the second parallel connection path 60 and then discharged to the exterior.

The second parallel connection path 60 may be connected to the second gateway 12 so that the refrigerant passing through the first and second headers 61 and 62 is discharged to the second gateway 12 through the second parallel connection path 60.

As described above, since the refrigerant passes through each of the first and second unit paths 20 and 30, the number of paths through which the refrigerant passes equals to the sum of the number of paths in the first unit path 20 and the number of paths in the second unit path 30. Thus, the number of paths through which the refrigerant passes in the heating operation is greater than that in the cooling operation, and the length of paths through which the refrigerant passes in the heating operation is shorter than that in the cooling operation.

That is, since the flow speed of the refrigerant changed into a gaseous state is increased in the process of performing evaporation in the outdoor heat exchanger 10, the length of paths through which the refrigerant passes is set to be relatively short, so that it is possible to decrease the flow speed of the refrigerant and to enhance efficiency. Further, evaporation pressure drop is prevented, so that the low pressure of the air conditioner may be increased, thereby enhancing the entire efficiency of the air conditioner.

Referring to FIG. 3, when the air conditioner according to the first embodiment of the present invention is in the cooling operation, the outdoor heat exchanger 10 is used as a condenser.

A gaseous refrigerant in a high-temperature and high-pressure state flows through the second gateway 12 of the outdoor heat exchanger 10. The refrigerant flows into the first unit path 20 through the first header 61.

The parallel connection valve 64 is provided to the second parallel connection path 60 so as to prevent the refrigerant from flowing into the side of the second header 62 from the first header 61. Thus, the refrigerant flowing into the first header 61 does not flow into the side of the second head 62 but may flow into the first unit path 20.

The refrigerant passing through the first unit path 20 sequentially passes through the first distributor 51 and the first distributor path 50*a*, and then flows into the second header 62 through the series connection path 70. The series connection valve 72 is opened so that the refrigerant can pass through the series connection path 70. The backflow prevention valve 54 prevents the refrigerant from flowing into the side of the second distributor path 50*b*.

That is, if the series connection valve 72 is opened, the first and second unit paths 20 and 30 are connected in series to each other by the series connection path 70.

Thus, the refrigerant passing through the first unit path 20 flows into the second header 62 through the series connection path 70 and then passes through the second unit path 30. The refrigerant condensed while passing through the second unit path 30 is discharged to the exterior through the first gateway 11 of the outdoor heat exchanger 10.

As described above, since the refrigerant passes through the first unit path 20 and then passes through the second unit path 30 in the cooling operation, the number of paths through which the refrigerant passes is decreased by half, and the length of paths through the refrigerant passes equals to the sum of the length of the first unit path 20 and the length of the second unit path 30, which is longer than that in the heating operation.

The flow speed of the refrigerant changed into a liquefied state is relatively decreased in the process of performing condensation in the outdoor heat exchanger 10. In this embodiment, the length of paths through which the refrigerant passes is lengthened, so that it is possible to increase the flow speed of the refrigerant and to enhance heat exchange efficiency.

Figure 7:
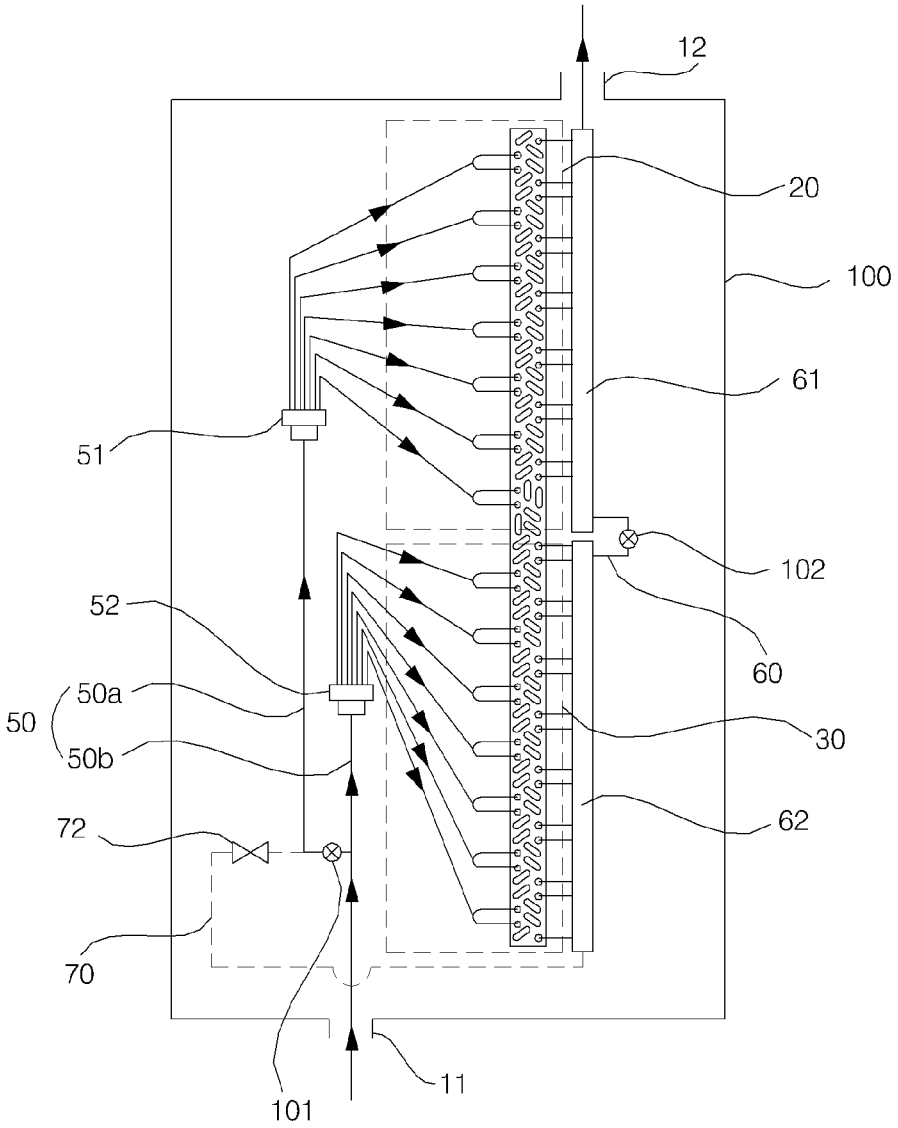
FIG. 7 is a schematic diagram illustrating the flow of a refrigerant in an outdoor heat exchanger when an air conditioner is in heating operation according to a second embodiment of the present invention.
Figure 8:
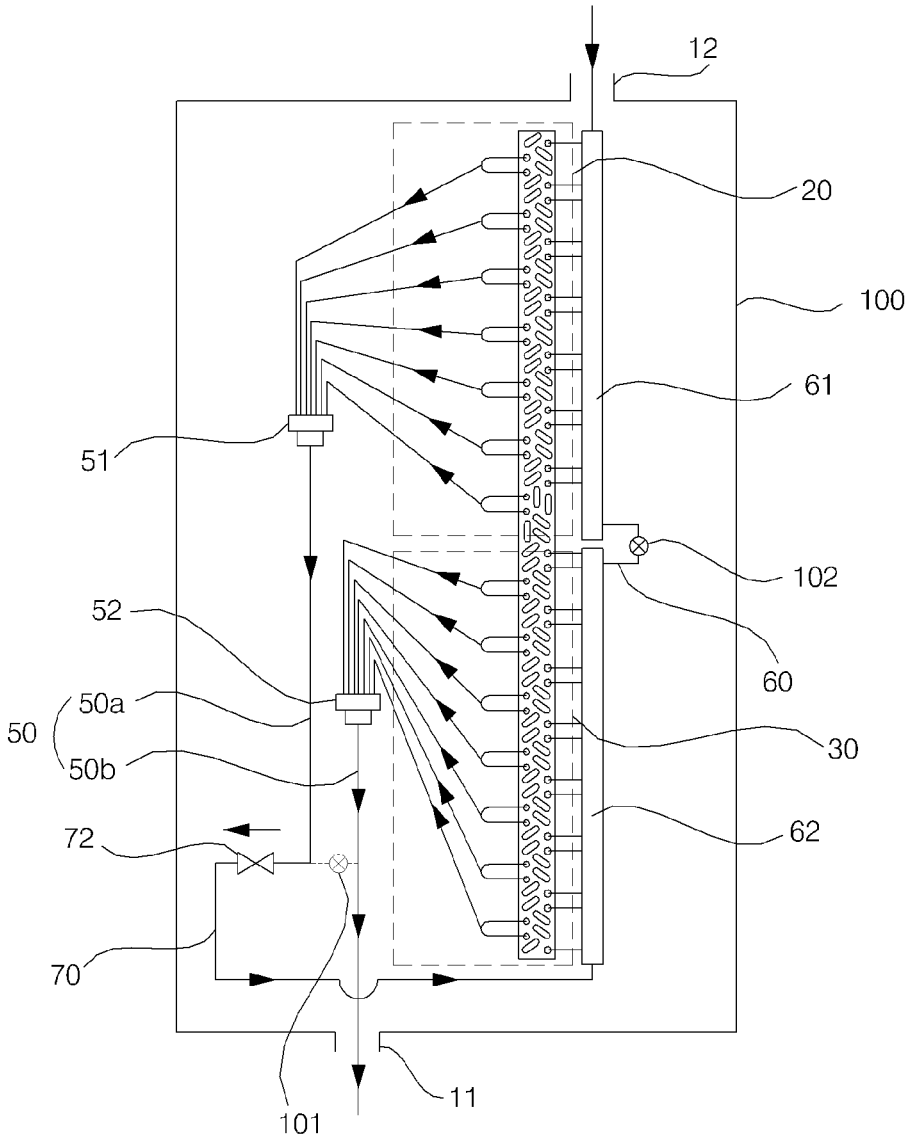
FIG. 8 is a schematic diagram illustrating the flow of the refrigerant in the outdoor heat exchanger when the air conditioner is in cooling operation according to the second embodiment of the present invention.

FIG. 7 is a schematic diagram illustrating the flow of a refrigerant in an outdoor heat exchanger when an air conditioner is in heating operation according to a second embodiment of the present invention. FIG. 8 is a schematic diagram illustrating the flow of the refrigerant in the outdoor heat exchanger when the air conditioner is in cooling operation according to the second embodiment of the present invention.

Referring to FIGS. 7 and 8, the components and operations of the outdoor heat exchanger 100 according to the second embodiment of the present invention are identical to those of the first embodiment, except that the first and second unit paths 20 and 30 are connected in parallel to each other by the first and second parallel connection paths 50 and 60, a first opening/closing valve 101 provided between the first and second distributor connection paths 50*a* and 50*b* in the first parallel connection path 50, and a second opening/closing valve 102 provided in the second parallel connection path 60. The opening/closing of the first opening/closing valve 101 and the second opening/closing valve 102 may be performed by the controller. Like components are designated by like reference numerals, and their detailed descriptions will be omitted.

Referring to FIG. 7, in heating operation, the first opening/closing valve 101 opens between the first and second distributor connection paths 50*a* and 50*b*, and the second opening/closing valve 102 opens the second parallel connection path 60. The series connection valve 72 closes the series connection path 70. The opening/closing of the series connection 72 may be performed by the controller.

Thus, the first and second unit paths 20 and 30 are connected in parallel to each other.

Referring to FIG. 8, in cooling operation, the first opening/closing valve 101 closes between the first and second distributor connection paths 50*a* and 50*b*, and the second opening/closing valve 102 closes the second parallel connection path 60. The series connection valve 72 opens the series connection path 70.

Thus, the parallel connection of the first and second unit paths 20 and 30 is broken, and the first and second unit paths 20 and 30 are connected in series to each other by the series connection path 70.

The first opening/closing valve 101 and the second opening/closing valve 102 are controlled according to the cooling/heating operation, so that it is easy to switch the serial or parallel connection of the first and second unit paths 20 and 30 to the parallel or series connection of the first and second unit paths 20 and 30.

Figure 9:
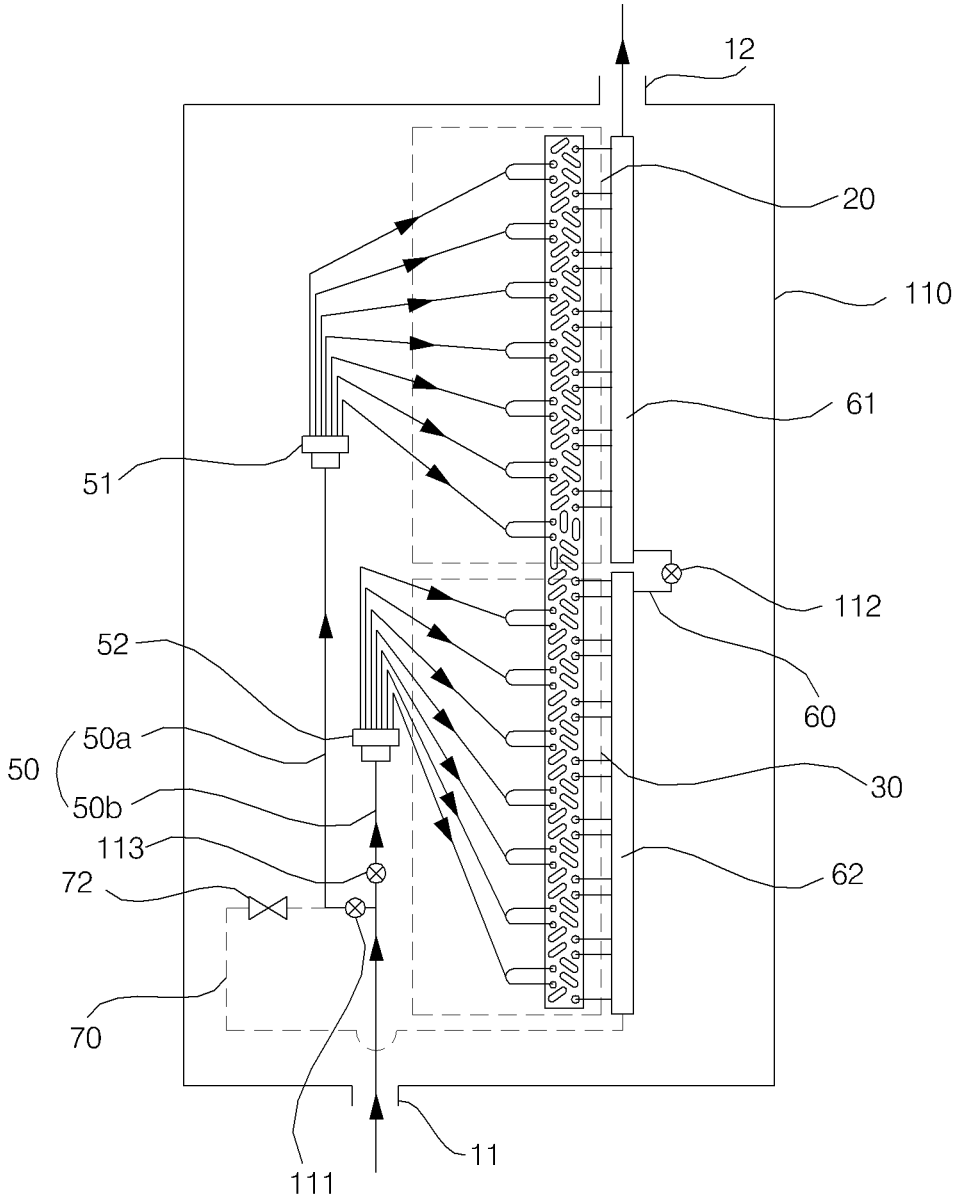
FIG. 9 is a schematic diagram illustrating the flow of a refrigerant in an outdoor heat exchanger when an air conditioner is in heating operation according to a third embodiment of the present invention.
Figure 10:
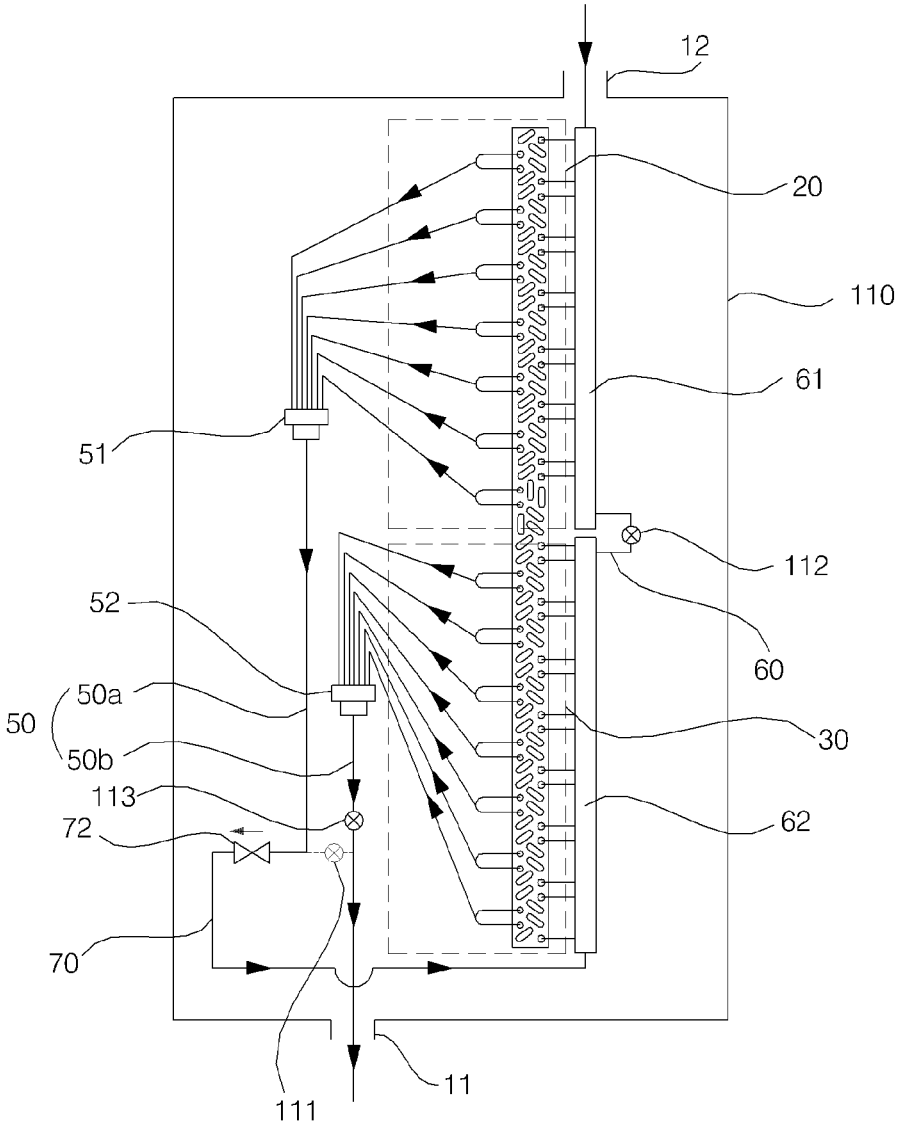
FIG. 10 is a schematic diagram illustrating the flow of the refrigerant in the outdoor heat exchanger when the air conditioner is in standard cooling operation according to the third embodiment of the present invention.
Figure 11:
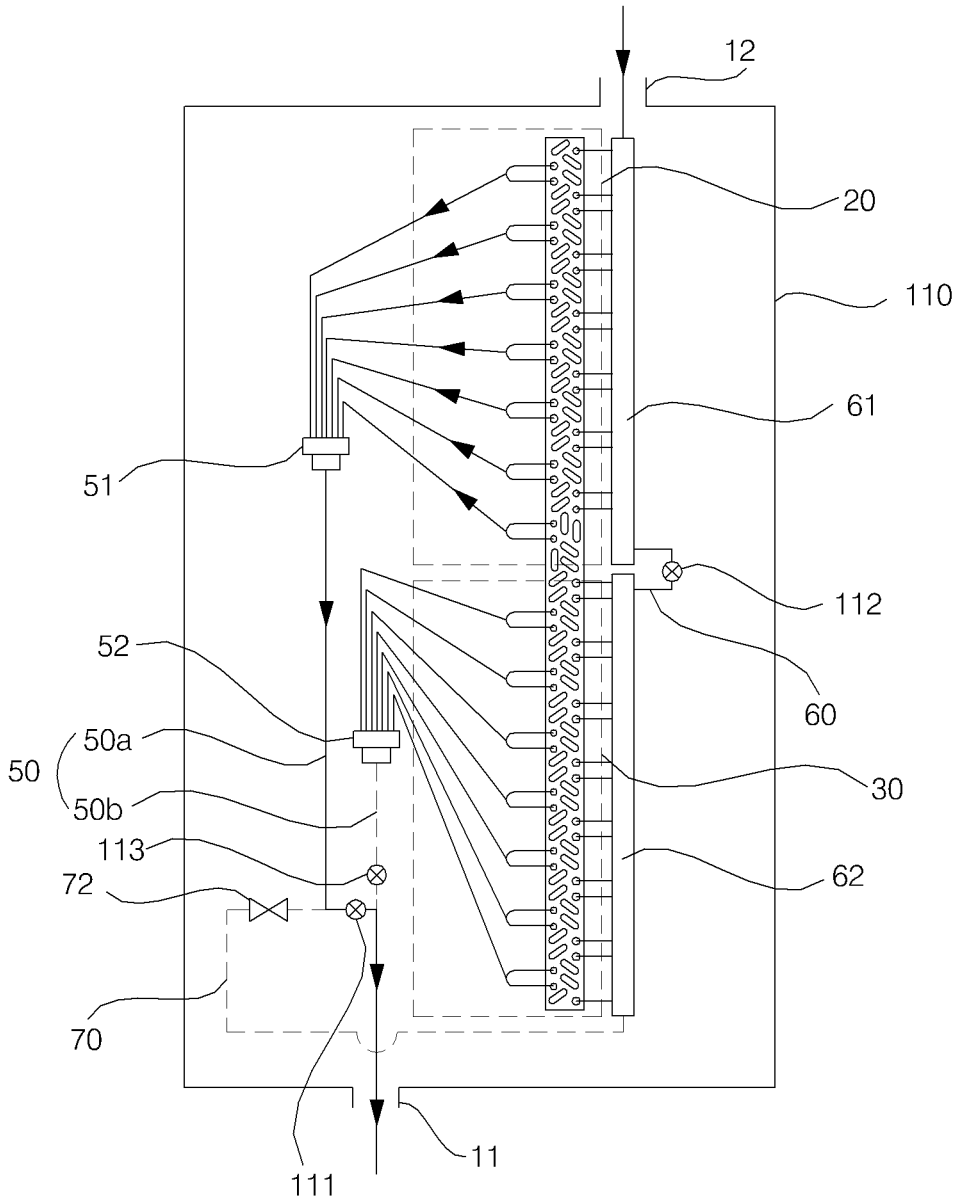
FIG. 11 is a schematic diagram illustrating the flow of the refrigerant in the outdoor heat exchanger when the air conditioner is in low-temperature cooling operation according to the third embodiment of the present invention.

FIG. 9 is a schematic diagram illustrating the flow of a refrigerant in an outdoor heat exchanger when an air conditioner is in heating operation according to a third embodiment of the present invention. FIG. 10 is a schematic diagram illustrating the flow of the refrigerant in the outdoor heat exchanger when the air conditioner is in standard cooling operation according to the third embodiment of the present invention. FIG. 11 is a schematic diagram illustrating the flow of the refrigerant in the outdoor heat exchanger when the air conditioner is in low-temperature cooling operation according to the third embodiment of the present invention.

Referring to FIGS. 9 to 11, the components and operations of the outdoor heat exchanger 110 according to the third embodiment of the present invention are identical to those of the first embodiment, except that the first and second unit paths 20 and 30 are connected in parallel to each other by the first and second parallel connection paths 50 and 60, a first parallel connection valve 111 is provided between the first and second distributor connection paths 50*a* and 50*b* in the first parallel connection path 50, a second parallel connection valve 112 is provided to the second parallel connection path 60, and an opening/closing valve 113 is provided to the second distributor connection path 50*b*. The opening/closing of the first parallel connection valve 111, the second parallel connection valve 112, and the opening/closing valve 113 may be performed by the controller. Like components are designated by like reference numerals, and their detailed descriptions will be omitted.

Referring to FIG. 9, in heating operation, the first parallel connection valve 111 opens between the first and second distributor connection paths 50*a* and 50*b*, and the second parallel connection valve 112 opens the second parallel connection path 60. The opening/closing valve 113 opens the second distributor connection path 50*b*. The series connection valve 72 closes the series connection path 70. The opening/closing of the series connection valve 72 may be performed by the controller.

Thus, the first and second unit paths 20 and 30 are connected in parallel to each other, and the refrigerant flowing through the first gateway 11 of the outdoor heat exchanger 110 flows into the first and second unit paths 20 and 30 through the first and second distributor connection paths 50*a* and 50*b*.

Referring to FIG. 10, in cooling operation, the first parallel connection valve 111 closes between the first and second distributor connection paths 50*a* and 50*b*, and the second parallel connection valve 112 closes the second parallel connection path 60. The opening/closing valve 113 closes the second distributor connection path 50*b*. The series connection valve 72 opens the series connection path 70.

Thus, the parallel connection of the first and second unit paths 20 and 30 is broken, and the first and second unit paths 20 and 30 are connected in series to each other by the series connection path 70.

The refrigerant flowing through the second gateway 12 of the outdoor heat exchanger 110 passes through the first unit path 20, and the refrigerant discharged from the first unit path 20 flows into the second unit path 30 through the first distributor connection path 50*a* and the series connection path 70.

Thus, the first and second parallel connection valves 111 and 112 are controlled according to the cooling/heating operation, so that it is easy to switch the serial or parallel connection of the first and second unit paths 20 and 30 to the parallel or series connection of the first and second unit paths 20 and 30.

Referring to FIG. 11, the outdoor heat exchanger 110 according to the third embodiment of the present invention may use only one of the first and second unit paths 20 and 30 in low-temperature operation with a small load such as indoor cooling operation performed when outdoor temperature is low. In this embodiment, the first unit path 20 is used in the low-temperature operation.

As shown in FIG. 11, the first parallel connection valve 111 opens the first parallel connection path 50, and the opening/closing valve 113 closes the second distributor connection path 50*b*. The series connection valve 72 closes the series connection path 70.

The refrigerant flowing through the second gateway 12 of the outdoor heat exchanger 110 flows into the first distributor connection path 50*a* through the first header 61 and the first unit path 20. The refrigerant condensed in the first unit path 20 passes through the first parallel connection valve 111 and is then discharged to the exterior through the first gateway 11 of the outdoor heat exchanger 110. That is, in low-temperature cooling with the small load, the refrigerant discharged from the first unit path 20 is not bypassed to the series connection path 70. Further, the refrigerant discharged from the first unit path 20 does not flow into the side of the first distributor connection path 50*b* but is immediately discharged to the exterior of the outdoor heat exchanger 110.

In this embodiment, the refrigerant path of the outdoor heat exchanger 110 is divided into two unit paths. However, in a case where the refrigerant path of the outdoor heat exchanger 110 is divided into a plurality of unit paths, some unit paths may be selectively used according to the load of the outdoor heat exchanger 110.

Figure 12:
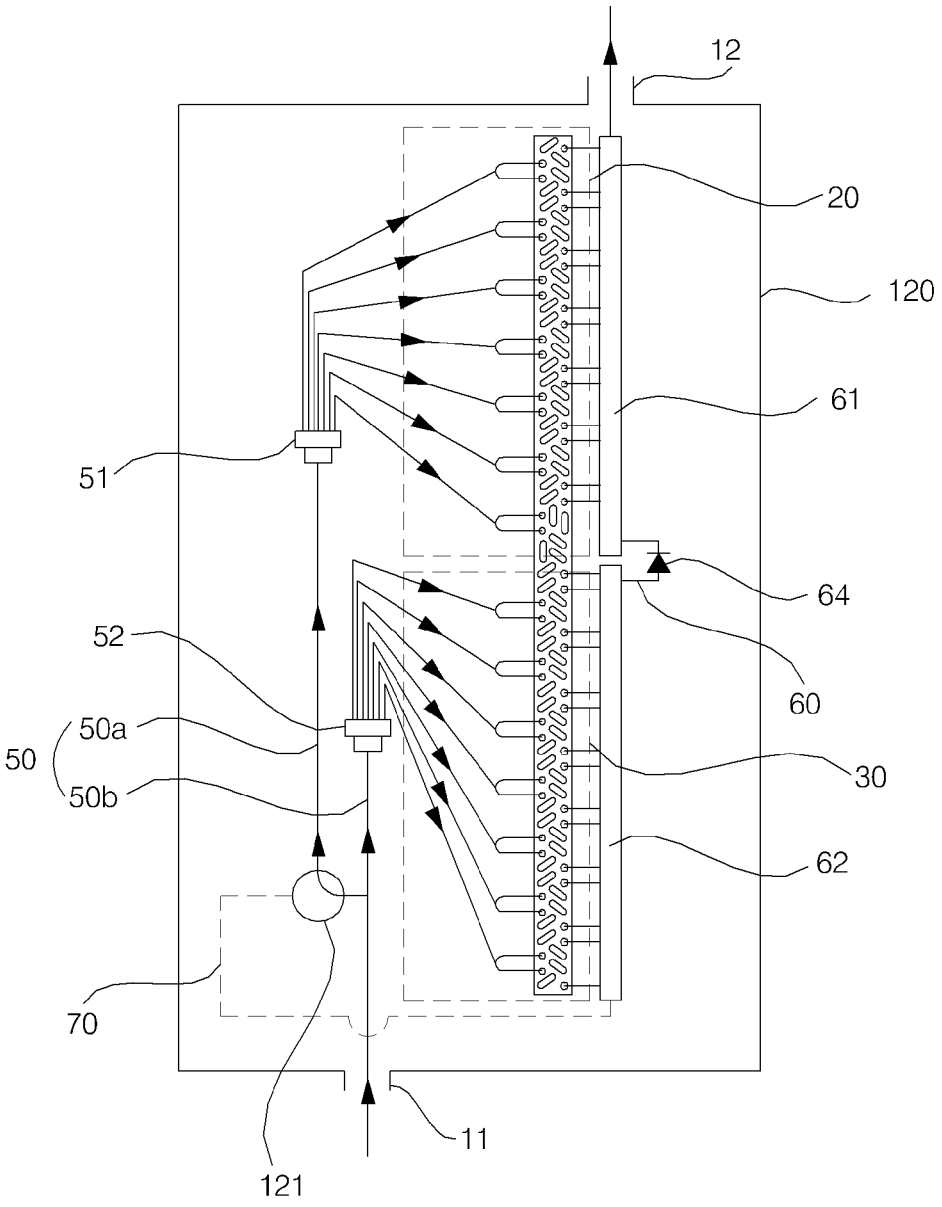
FIG. 12 is a schematic diagram illustrating the flow of a refrigerant in an outdoor heat exchanger when an air conditioner is in heating operation according to a fourth embodiment of the present invention.
Figure 13:
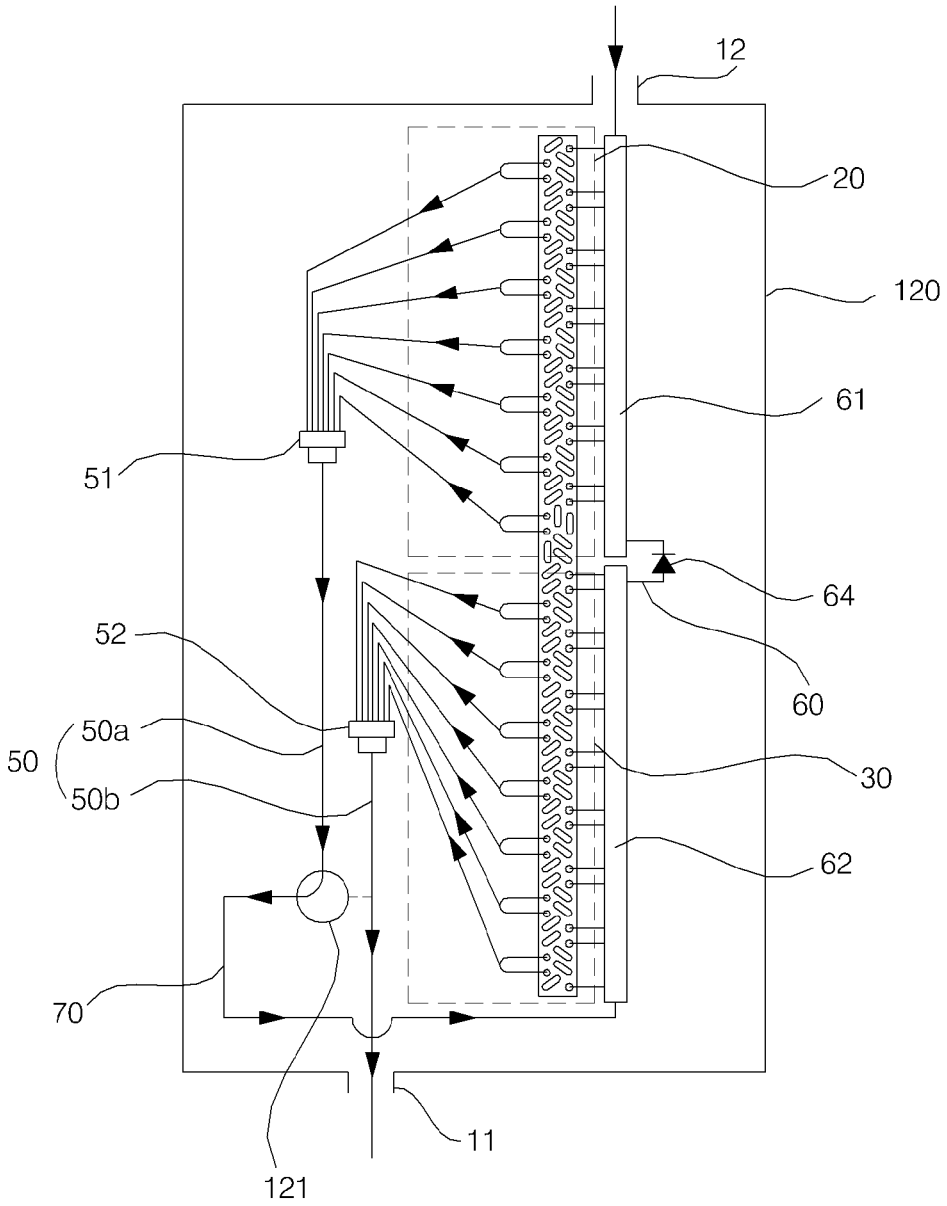
FIG. 13 is a schematic diagram illustrating the flow of the refrigerant in the outdoor heat exchanger when the air conditioner is in cooling operation according to the fourth embodiment of the present invention.

FIG. 12 is a schematic diagram illustrating the flow of a refrigerant in an outdoor heat exchanger when an air conditioner is in heating operation according to a fourth embodiment of the present invention. FIG. 13 is a schematic diagram illustrating the flow of the refrigerant in the outdoor heat exchanger when the air conditioner is in cooling operation according to the fourth embodiment of the present invention.

Referring to FIGS. 12 and 13, the components and operations of the outer heat exchanger 120 according to the fourth embodiment of the present invention are identical to those of the first embodiment, except that the first and second unit paths 20 and 30 are connected in parallel to each other by the first and second parallel connection paths 50 and 60, the outdoor heat exchanger 120 further includes a series connection path 70 bypassed in the first parallel connection path 50 so as to connect the first and second unit paths in serial to each other, and a four-way valve 121 that switch the paths to serial or parallel connection according to the cooling/heating operation is provided at a connection point of the series connection path 70 and the first parallel connection path 50. The switching of the four-way valve 121 may be performed by the controller. Like components are designated by like reference numerals, and their detailed descriptions will be omitted.

Referring to FIG. 12, in heating operation, the four-way valve 121 is operated so that the first and second distributor connection paths 50*a* and 50*b* are connected. The four-way valve 121 is operated so that connection of the series connection path 70 is broken. Thus, the first and second unit paths 20 and 30 are connected in parallel to each other by the first and second distributor connection paths 50*a* and 50*b*.

The refrigerant flowing through the first gateway 11 of the outdoor heat exchanger 120 flows into each of the first and second unit paths 20 and 30 through the first and second distributor connection paths 50*a* and 50*b*.

Referring to FIG. 13, in cooling operation, the four-way valve 121 is operated so that the first distributor connection path 50*a* is connected to the series connection path 70. The four-way valve 121 is operated so that the connection to the second distributor connection path 50*b* is broken. Thus, the first and second unit paths 20 and 30 are connected in series to each other by the series connection path 70.

The refrigerant condensed while passing through the first unit path 20 flows into the second unit path 30 through the series connection path 70, condensed and then discharged to the exterior of the outdoor heat exchanger 120.

Since the four-way valve 121 is used, it may be unnecessary to use a separate check valve that prevents the refrigerant discharged from the first unit path 30 from flowing back to the exit side of the second unit path 30. Thus, the configuration of the outdoor heat exchanger may be simplified, and the outdoor heat exchanger may be easily controlled.

Figure 14:
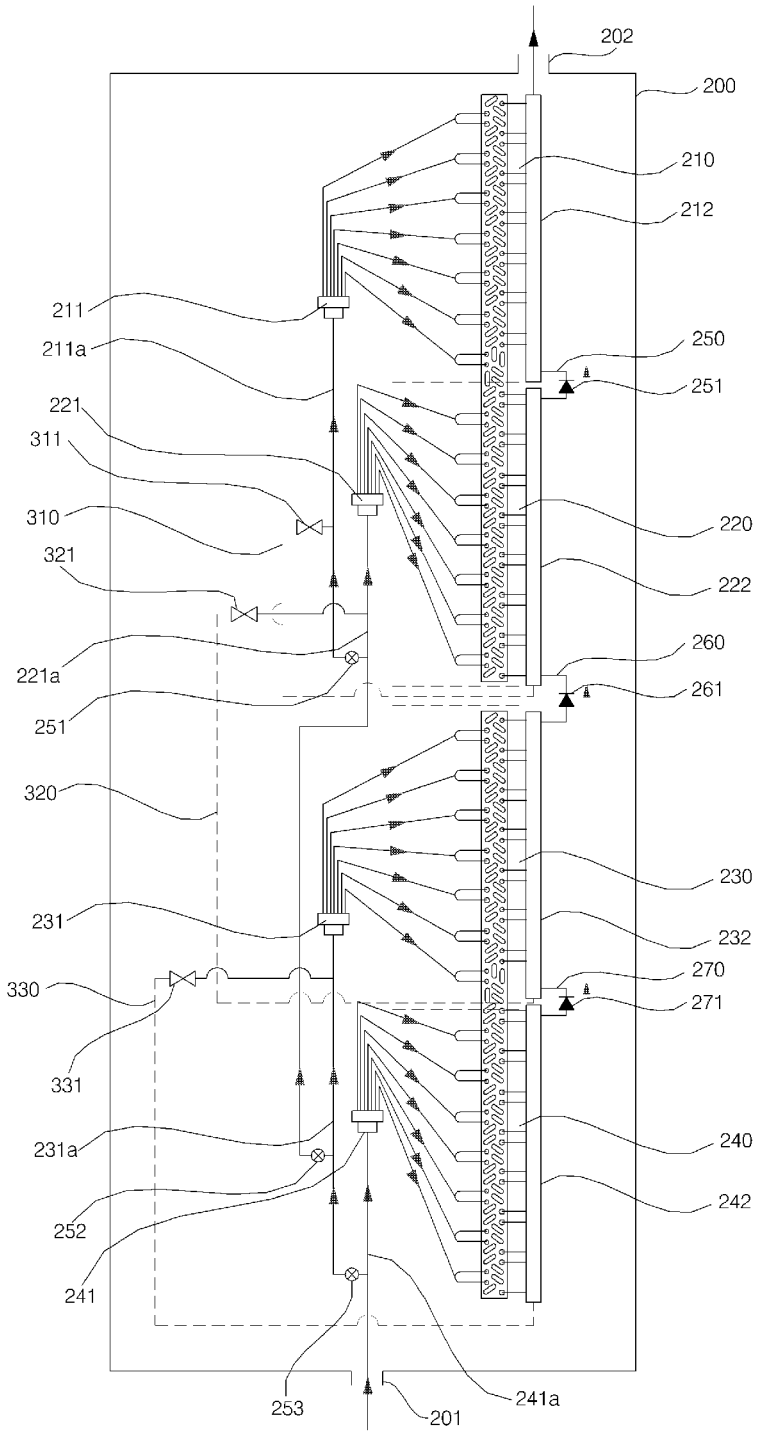
FIG. 14 is a schematic diagram illustrating the flow of a refrigerant in an outdoor heat exchanger when an air conditioner is in heating operation according to a fifth embodiment of the present invention.
Figure 15:
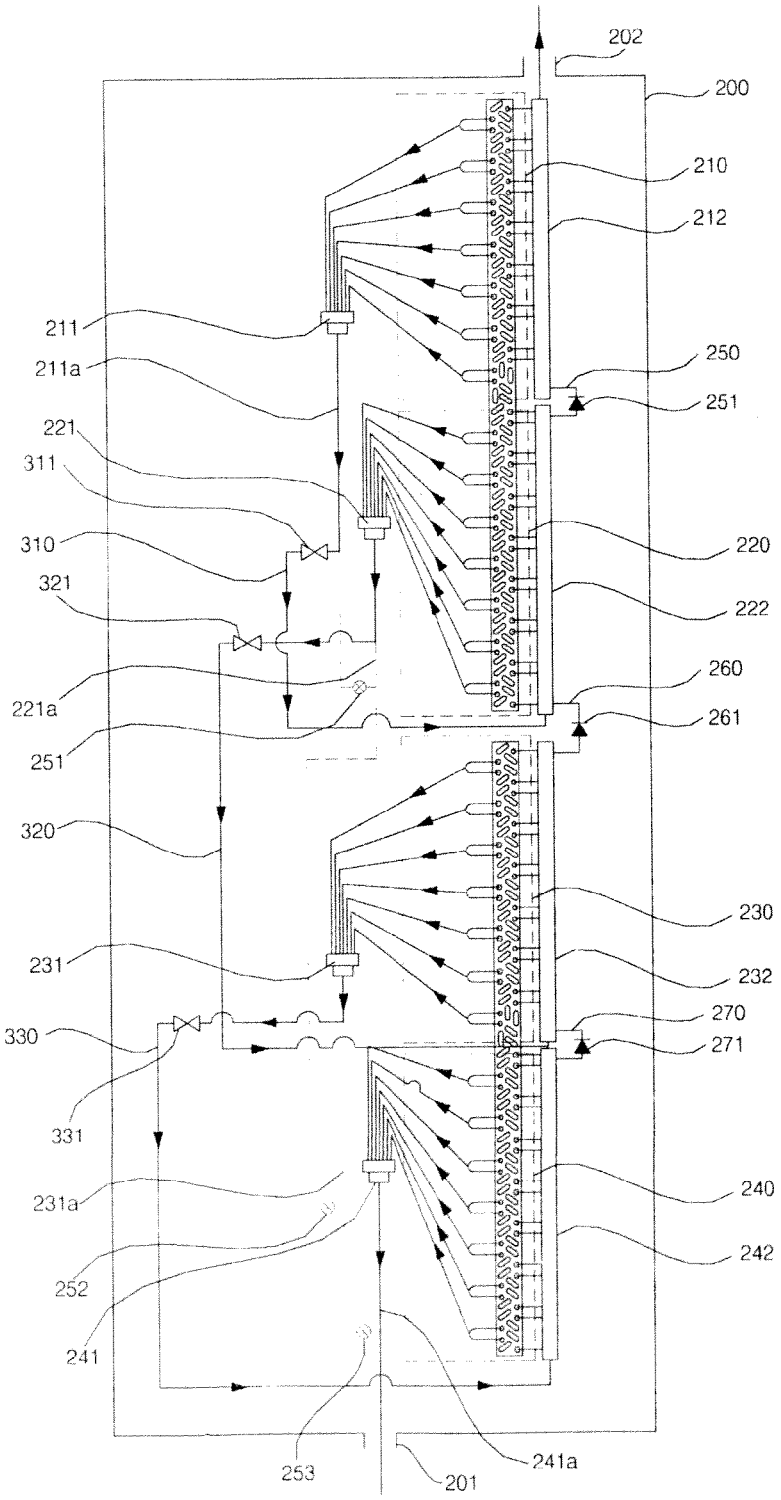
FIG. 15 is a schematic diagram illustrating the flow of the refrigerant in the outdoor heat exchanger when the air conditioner is in cooling operation according to the fifth embodiment of the present invention.

FIG. 14 is a schematic diagram illustrating the flow of a refrigerant in an outdoor heat exchanger when an air conditioner is in heating operation according to a fifth embodiment of the present invention. FIG. 15 is a schematic diagram illustrating the flow of the refrigerant in the outdoor heat exchanger when the air conditioner is in cooling operation according to the fifth embodiment of the present invention.

Referring to FIGS. 14 and 15, the components and operations of the outdoor heat exchanger 200 according to the fifth embodiment of the present invention are identical to those of the first embodiment, except that the refrigerant path is divided into four unit paths, and the four unit paths are connected in parallel to one another in heating operation and connected in series to one another in cooling operation. Therefore, like components are designated by like reference numerals, and their detailed descriptions will be omitted.

The four unit paths include first, second, third and fourth unit paths 210, 220, 230 and 240. First, second, third and fourth distributors 211, 221, 231 and 241 are provided at one sides of the first, second, third and fourth unit paths 210, 220, 230 and 240, respectively. First, second, third and fourth headers 212, 222, 232 and 242 are provided at the other sides of the first, second, third and fourth unit paths 210, 220, 230 and 240, respectively.

First, second, third and fourth distributor connection paths 211*a*, 221*a*, 231*a* and 241*a* are connected to the first, second, third and fourth distributors 211, 221, 231 and 241, respectively. The first, second, third and fourth distributors 211, 221, 231 and 241 may be connected in parallel to one another by the first, second, third and fourth distributor connection paths 211*a*, 221*a*, 231*a* and 241*a*.

The first header 212 and the second header 222 are connected to a first header connection path 250, and a first parallel connection valve 251 is provided to the first header connection path 250. The first parallel connection valve 251 closes the first header connection path 250 in the cooling operation, and opens the first header connection path 250 in the heating operation. A check valve may be used as the first parallel connection valve 251.

The second header 222 and the third header 232 are connected to a second header connection path 260, and a second parallel connection valve 261 is provided to the second header connection path 260. The second parallel connection valve 261 closes the second header connection path 260 in the cooling operation, and opens the second header connection path 260 in the heating operation.

A check valve may be used as the second parallel connection valve 261.

The third header 232 and the fourth header 242 are connected to a third header connection path 270, and a third parallel connection valve 271 is provided to the third header connection path 270. The third parallel connection valve 271 closes the third header connection path 270 in the cooling operation, and opens the third header connection path 270 in the heating operation.

A check valve may be used as the third parallel connection valve 271.

The opening/closing of the first parallel connection valve 251, the second parallel connection valve 261, and the third parallel connection valve 271 may be performed by the controller.

The outdoor heat exchanger 200 further includes a first series connection path 310 bypassed from the first distributor connection path 211*a* so as to connect the first and second unit paths 210 and 220 in series to each other, a second series connection path 320 bypassed from the second distributor connection path 221*a* so as to connect the second and third unit paths 220 and 230 in series to each other, and a third series connection path 330 bypassed from the third distributor connection path 231*a* so as to connect the third and fourth unit paths 230 and 240 in series to each other.

A first series connection valve 311 is provided to the first series connection path 310. The first series connection valve 311 opens/closes the first series connection path 310 only in the cooling operation.

A second series connection valve 321 is provided to the second series connection path 320. The second series connection valve 321 opens/closes the second series connection path 320 only in the cooling operation.

A third series connection valve 331 is provided to the third series connection path 330. The third series connection valve 331 opens/closes the third series connection path 330 only in the cooling operation.

The opening/closing of the first series connection valve 311, the second series connection valve 321, and the third series connection valve 331 may be performed by the controller.

A first opening/closing valve 251 is provided between the first and second distributor connection paths 211*a* and 221*a*. The first opening/closing valve 251 prevents the refrigerant discharged from the first unit path 210 from flowing back to an entrance side of the second unit path 220 in the cooling operation.

A second opening/closing valve 252 is provided between the second and third distributor connection paths 221*a* and 231*a*. The second opening/closing valve 252 prevents the refrigerant discharged from the second unit path 220 from flowing back to an exit side of the third unit path 230 in the cooling operation.

A third opening/closing valve 253 is provided between the third and fourth distributor connection paths 231*a* and 241*a*.

The third opening/closing valve 253 prevents the refrigerant discharged from the third unit path 230 from flowing back to an exit side of the fourth unit path 240 in the cooling operation.

The opening/closing of the first opening/closing valve 251, the second opening/closing valve 252, and the third opening/closing valve 253 may be performed by the controller.

The operation of the outdoor heat exchanger according to the fifth embodiment of the present invention as configured above will now be described as follows.

Referring to FIG. 14, in the heating operation, the refrigerant flowing through a first gateway 201 of the outdoor heat exchanger 200 flows into the first, second, third and fourth unit paths 210, 220, 230 and 240 through the first, second, third and fourth distributor connection paths 211*a*, 221*a*, 231*a* and 241*a*, condensed and then discharged to the exterior of the outdoor heat exchanger 200 through the first, second, third and fourth headers 212, 222, 232 and 234.

Since the first, second and third series connection valves 311, 321 and 331 close the first, second and third series connection paths 310, 320 and 330, respectively, the first, second, third and fourth unit paths 210, 220, 230 and 240 are not connected in series to one another but connected in parallel to one another.

As the first, second, third and fourth unit paths 210, 220, 230 and 240 are connected in parallel to one another, the length of paths through which the refrigerant passes is shortened, and the number of paths is increased. Thus, the heat exchange efficiency in the heating operation can be enhanced.

Referring to FIG. 15, in the cooling operation, the first, second and third series connection valves 311, 321 and 331 open the first, second and third series connection paths 310, 320 and 330, respectively, so that the first, second, third and fourth unit paths 210, 220, 230 and 240 are connected in series to one another.

The refrigerant flowed through a second gateway 202 of the outdoor heat exchanger 200 is flowed into the first unit path 210 through the first header 212, condensed and then bypassed to the first series connection path 310. The bypassed refrigerant is flowed into the second path 220 through the second header 222 and then condensed.

The refrigerant discharged from the second unit path 220 is bypassed to the second series connection path 320, flowed into the third unit path 230 through the third header 232 and then condensed.

The refrigerant discharged from the third unit path 230 is bypassed to the third series connection path 330, flowed into the fourth unit path 240 through the fourth header 242 and then condensed.

The refrigerant discharged from the fourth unit path 240 is discharged to the exterior through the first gateway 201 of the outdoor heat exchanger 200.

As described above, the first, second, third and fourth unit paths 210, 220, 230 and 240 are connected in series or parallel to one another according to the cooling/heating operation, so that it is possible to obtain the optimal heat exchange performance regardless of the cooling/heating operation.

While the fifth embodiment has been described such that the four unit paths are connected in parallel to one another in heating operation and connected in series to one another in cooling operation, the air conditioner need not be configured to operate in these two specific configurations. For instance, in another embodiment, the air conditioner may be configured such that at least two unit paths are connected in parallel and the remaining unit paths not connected in parallel is/are connected in series. Similarly, at least two unit paths may be connected in series and the remaining unit paths not connected in series is/are connected in parallel. The air conditioner need not be limited to four unit paths and may include a plurality of unit paths which may be more than or less than four.

The invention has been explained above with reference to exemplary embodiments. It will be evident to those skilled in the art that various modifications may be made thereto without departing from the broader spirit and scope of the invention. Further, although the invention has been described in the context its implementation in particular environments and for particular applications, those skilled in the art will recognize that the present invention's usefulness is not limited thereto and that the invention can be beneficially utilized in any number of environments and implementations. The foregoing description and drawings are, accordingly, to be regarded in an illustrative rather than a restrictive sense.

What is claimed is:

1. An air conditioner comprising:

a heat exchanger including a refrigerant path divided into a plurality of unit paths;

a path switch part that connects at least two of the plurality of unit paths in parallel to one another in heating operation or switches at least two of the plurality of unit paths to be connected in series to one another in cooling operation;

a first parallel connection path that connects one sides of the at least two of the plurality of unit paths in parallel to one another so that a refrigerant flowing into the heat exchanger flows into the at least two of the plurality of unit paths connected in parallel in the heating operation; and a second parallel connection path that connects other sides of the at least two of the plurality of unit paths in parallel to one another so that the refrigerant passing through the at least two of the plurality of unit paths connected in parallel is discharged to the second parallel connection path in the heating operation.

2. The air conditioner of claim 1, further comprising a controller, wherein the controller controls the path switch part.

3. The air conditioner of claim 1, wherein the heat exchanger further comprises a series connection path that connects the at least two of the plurality of unit paths in series to one another so that the refrigerant passing through one of the at least two of the plurality of unit paths is passed to an entrance side of another unit path connected in series.

4. The air conditioner of claim 3, wherein the path switch part comprises a series connection valve that opens the series connection path in the cooling operation and closes the series connection path in the heating operation.

5. The air conditioner of claim 1, wherein the path switch part comprises a backflow prevention valve provided to the first parallel connection path to prevent the refrigerant passing through one of the plurality of unit paths from flowing back to an exit side of another unit path in the cooling operation.

6. The air conditioner of claim 1, wherein the path switch part comprises a backflow prevention valve provided to the second parallel connection path to prevent the refrigerant passing through one of the plurality of unit paths from flowing back to an entrance side of another unit path in the cooling operation.

7. The air conditioner of claim 1, wherein the path switch part comprises a parallel connection valve provided to the second parallel connection path to close the second parallel connection path in the cooling operation and to open the second parallel connection path in the heating operation.

8. The air conditioner of claim 3, wherein the path switch part comprises a four-way valve provided at a connection point of the first parallel connection path and the series connection path to switch paths according to the cooling/heating operation.

9. The air conditioner of claim 3, wherein the path switch part comprises a series connection valve provided to the series connection path to open the series connection path in cooling operation with a predetermined reference load range and to close the series connection path in low-temperature cooling operation that exceeds the reference load range.

10. The air conditioner of claim 9, wherein the path switch part comprises a first parallel connection valve provided to a side of one of the plurality of unit paths in the first parallel connection path to open an exit side of the first parallel connection path so that the refrigerant passing through the unit path is discharged through the first parallel connection path in the low-temperature cooling operation.

11. The air conditioner of claim 10, wherein the path switch part comprises a second parallel connection valve provided to a side of another unit path in the first parallel connection path to prevent the refrigerant passing through one of the plurality of unit paths from flowing into a side of another unit path in the low-temperature cooling operation.

12. The air conditioner of claim 1, wherein the heat exchanger comprises:

a plurality of distributors that are respectively provided to correspond to the plurality of unit paths on the first parallel connection path and guides a refrigerant to the plurality of unit paths in the heating operation; and a plurality of headers that are respectively provided to correspond to the plurality of unit paths on the second parallel connection path and has the refrigerant passing through the plurality of unit paths, discharged therefrom in the heating operation.

13. An air conditioner comprising:

a heat exchanger comprising;

a refrigerant path divided into a plurality of unit paths;

a parallel connection path that connects at least two of the plurality of unit paths in parallel to one another;

a series connection path that connects at least two of the plurality of unit paths in series to one another; and a path switch part that is provided to at least one of the parallel and series connection paths to switch paths so that the parallel and series connection paths are selectively used according to cooling/heating operation.

14. The air conditioner of claim 13, further comprising a controller, wherein the controller controls the path switch part.

15. The air conditioner of claim 13, wherein the path switch part comprises a series connection valve that opens the series connection path in the cooling operation and closes the series connection path in the heating operation.

16. The air conditioner of claim 15, wherein the path switch part comprises a parallel connection valve provided to the parallel connection path to close the parallel connection path in the cooling operation and to open the parallel connection path in the heating operation.

17. The air conditioner of claim 15, wherein the path switch part further comprises a check valve provided to the parallel connection path to prevent a refrigerant from flowing into the parallel connection path in the cooling operation.

18. The air conditioner of claim 13, wherein the path switch part comprises a four-way valve provided at a connection point of the parallel and series connection paths to switch paths according to the cooling/heating operation.

19. The air conditioner of claim 13, wherein paths of the plurality of unit paths are all of the same length.

20. An air conditioner comprising:

a heat exchanger including a plurality of unit paths;

a first parallel connection path that connects entrance sides of at least two of the plurality of unit paths in parallel to one another so that a refrigerant flows into the at least two of the plurality of unit paths connected in parallel in heating operation;

a second parallel connection path that connects exit sides of the at least two of the plurality of unit paths in parallel to one another so that the refrigerant passing through the at least two of the plurality of unit paths connected in parallel is gathered in the heating operation;

a series connection path that connects at least two of the plurality of unit paths in series to one another so that the refrigerant passing through one of the at least two of the plurality of unit paths is passed to an entrance side of another unit path in series in the cooling operation;

a series connection valve provided to the series connection path to open the series connection path in cooling operation with a predetermined reference load range and to close the series connection path in low-temperature cooling operation that exceeds the reference load range;

a first parallel connection valve provided to the first parallel connection path to open the first parallel connection path in the heating operation and the low-temperature cooling operation; and a second parallel connection valve provided to the second parallel connection path to close the second parallel connection path in the cooling operation with the reference load range and the low-temperature cooling operation.

* * * * *